US006885986B1

(12) United States Patent
Gigi

(10) Patent No.: US 6,885,986 B1
(45) Date of Patent: Apr. 26, 2005

(54) REFINEMENT OF PITCH DETECTION

(75) Inventor: Ercan F. Gigi, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 855 days.

(21) Appl. No.: 09/306,960

(22) Filed: May 7, 1999

(30) Foreign Application Priority Data

May 11, 1998 (EP) ..... 98201525
Jun. 30, 1998 (EP) ..... 98202195

(51) Int. Cl.[7] ..... G10L 11/04
(52) U.S. Cl. ..... 704/207
(58) Field of Search ..... 704/207

(56) References Cited

U.S. PATENT DOCUMENTS 5,781,880 A * 7/1998 Su ..... 704/207

FOREIGN PATENT DOCUMENTS

EP 0527527 A2 2/1993
EP 0527529 A2 2/1993

OTHER PUBLICATIONS

"Measurement of Pitch by Subharmonic Summation", D.J. Hermes, Journal of the Acoustical Society of America, vol. 83, No. 1, 1988, pp. 257–264.
"Multiband Excitation Vocoder", Daniel W. Griffin and Jae S. Lim, IEEE Transactions on Acoustics, Speech and Signal Processing, vol. 36, No. 8, Aug. 1988, ppgs. 1223–1235.

* cited by examiner

*Primary Examiner*—Tālivaldis Ivars Šmits

(57) ABSTRACT

Successive pitch periods/frequencies are accurately determined in an audio equivalent signal. Using a suitable conventional pitch detection technique, an initial value of the pitch frequency/period is determined for so-called pitch detection segments of the audio equivalent signal. Based on the determined initial value, a refined value of the pitch frequency/period is determined. To this end, the signal is divided into a sequence of pitch refinement segments. Each pitch refinement segment is associated with at least one of the pitch detection segments. The pitch refinement segments are filtered to extract a frequency component with a frequency substantially corresponding to an initially determined pitch frequency of an associated pitch detection segment. The successive pitch periods/frequencies are determined in the filtered signal.

6 Claims, 6 Drawing Sheets

REFINEMENT OF PITCH DETECTION

BACKGROUND OF THE INVENTION

The invention relates to a method of determining successive pitch periods/frequencies in an audio equivalent signal; the method comprising:

dividing the audio equivalent signal into a sequence of mutually overlapping or adjacent pitch detection segments;

determining an initial value of the pitch frequency/period for each of the pitch detection segments; and based on the determined initial value, determining a refined value of the pitch frequency/period.

The invention further relates to an apparatus for determining successive pitch periods/frequencies in an audio equivalent signal, the apparatus comprising:

segmenting means for forming a sequence of mutually overlapping or adjacent pitch detection segments;

pitch detection means for determining an initial value of the pitch frequency/period for each of the pitch detection segments; and pitch refinement means for, based on the determined initial value, determining a refined value of the pitch frequency/period.

SUMMARY OF THE INVENTION

The invention relates to accurately determining a pitch period/frequency in an audio equivalent signal by refining a raw initial pitch value. The accurately determined pitch value may be used for various applications, such as speech coding, speech analysis and speech synthesis. In itself a pitch refinement method is known from "Multiband Excitation Vocoder" of Daniel W. Griffin and Jae S. Lim, IEEE Transactions on Acoustics, Speech and Signal Processing, Vol. 36, No. 8, August 1988, pages 1223–1235. According to this method, a speech signal is divided into a sequence of pitch detection segments by weighting the signal with a time window and shifting the window to select a desired segment. The segment has a duration of approximately 10–40 msec. The Fourier transform of pitch detection segment is modelled as the product of a spectral envelope and an excitation spectrum. The excitation spectrum is specified by the fundamental frequency and a frequency dependent binary voiced/unvoiced mixture function. An initial pitch period of a pitch detection segment is determined by computing an error criterion for all integer pitch periods from 20 to 120 samples for a 10 kHz sampling rate. The error condition consists of comparing the modelled synthetic spectrum to the actual spectrum of the segment. The pitch period that minimises the error criterion is selected as the initial pitch period. A refined pitch value is determined by using the best integer pitch period estimate as an initial coarse pitch period estimate. Then the error criterion is minimised locally to this estimate by using successively finer evaluation grids. The final pitch period estimate is chosen as the pitch period that produces the minimum error in this local minimisation.

To achieve an accurate estimate of the pitch, several iterations are required over successively finer grids. Moreover, calculating the error condition is computationally expensive. The known method uses a same, fixedly chosen, duration of the detection segments for the coarse evaluation as well as the finer evaluations. The duration of the segment extends over several pitch periods, particularly for high-pitched voices. This results in smearing/averaging a change of pitch within such an interval, limiting the accuracy with which the pitch can be detected.

It is an object of the invention to provide a method and apparatus of a kind set forth for determining successive pitch periods/frequencies in an audio equivalent signal, which enables accurate detection of the pitch at moderate computational requirements.

To meet the object of the invention, the method is characterised in that the step of determining a refined value of the pitch frequency/period comprises:

forming a sequence of pitch refinement segments by:

positioning a chain of time windows with respect to the audio equivalent signal; and weighting the signal according to an associated window function of the respective time window;

each pitch refinement segment being associated with at least one of the pitch detection segments forming a filtered signal by filtering each pitch refinement segment to extract a frequency component with a frequency substantially corresponding to an initially determined pitch frequency of an associated pitch detection segment; and determining the successive pitch periods/frequencies from the filtered signal.

According to the invention, any suitable technique may be used to determine a rough estimate of the pitch. Following making the initial estimate, the signal is filtered to extract the lowest harmonic present in the signal. The filtering follows the determined rough pitch value. For instance, a band-pass filter may be constantly adjusted as the signal is passed through the filter to filter the band around the pitch frequency of the corresponding part of the signal. In this way a filtered signal is obtained which is highly dominated by the pitch frequency component. Using a suitable technique, an accurate estimate of the pitch is made based on the filtered signal. The estimating of the pitch detection can in itself be simple, for instance based on peak or zero crossing detection.

The initial rough estimate may be made using relatively large pitch detection segments of, for instance, 40 msec, in order to be able to detect any possible pitch frequencies. As part of the refinement, which follows making the rough estimate, new pitch refinement segments are created. The duration of the refinement segments is in principle independent of the duration of the pitch detection segments used for making the rough estimate. Particularly if the pitch detection segments were relatively large, the duration of the pitch refinement segments is chosen such to avoid too much smearing/averaging of the pitch. In this way the filtering is adjusted to accurately follow the development of the pitch, resulting in an accurately filtered signal.

In an embodiment according to the invention as described in the dependent claim 2, the filtering is based on convolution with a sine/cosine pair at the initially estimated pitch frequency and representing the filtered segment by a created sine or cosine with the initially estimated pitch frequency. In this way, undesired signal components, such as noise, are not taken over.

In an embodiment according to the invention as described in the dependent claim 3, interpolation is used for increasing the resolution for sampled signals.

In an embodiment according to the invention as described in the dependent claim 4, the pitch refinement segment are created by displacing the time windows over a period that depends on the rough pitch estimate. For instance, the displacement of the windows to form the pitch refinement segment may correspond to a lowest measured pitch using the initial estimates, whereas the pitch detection segments were chosen at a fixed displacement of e.g. 40 msec. In this way, particularly for high pitched voices the pitch development can be followed much more accurately.

In an embodiment according to the invention as described in the dependent claim 5, the displacement corresponds to the initially determined pitch period for that part of the signal. Whenever a change of initial pitch value occurs, an asymmetrical window may be used. To avoid computational overhead, alternatively, a symmetrical window may be displaced over, for instance, an average of the involved initial pitch periods.

To meet the object of the invention, the apparatus is characterised in that the pitch refinement means comprises:

segmenting means for forming a sequence of pitch refinement segments by:

positioning a chain of time windows with respect to the audio equivalent signal; and weighting the signal according to an associated window function of the respective time window;

each pitch refinement segment being associated with at least one of the pitch detection segments;

filtering means for forming a filtered signal by filtering each pitch refinement segment to extract a frequency component with a frequency substantially corresponding to an initially determined pitch frequency of an associated pitch detection segment; and means for determining the successive pitch periods/frequencies from the filtered signal.

These and other aspects of the invention will be apparent from and elucidated with reference to the embodiments shown in the drawings.

DETAILED DESCRIPTION OF THE INVENTION

Pitch Refinement

Figure 1:
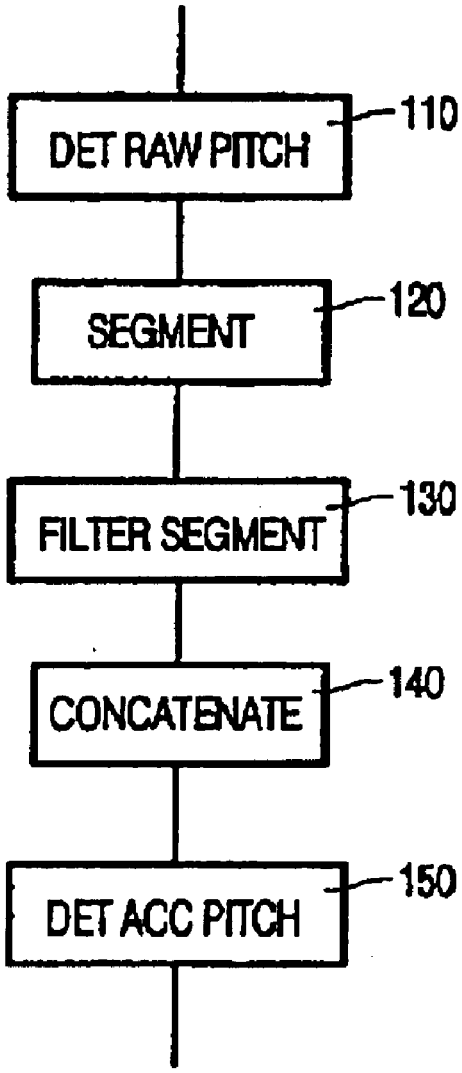
FIG. 1 shows accurately determining a pitch value using the first harmonic filtering technique according to the invention.

FIG. 1 illustrates accurately determining the pitch according to the invention. In step 110, a raw value for the pitch is obtained. In principle any suitable technique may be used to obtain this raw value. Preferably, the same technique is also used to obtain a binary voicing decision, which indicates which parts of the speech signal are voiced (i.e. having an identifiable periodic signal) and which parts are unvoiced. The pitch needs only be determined for the voiced parts. The pitch may be indicated manually, e.g. by adding voice marks to the signals. Preferably, the local period length, that is, the pitch value, is determined automatically. Most known methods of automatic pitch detection are based on determining the distance between peaks in the spectrum of the signal, such as for instance described in "Measurement of pitch by subharmonic summation" of D. J. Hermes, Journal of the Acoustical Society of America, Vol. 83 (1988), no.1, pages 257–264. Typically the known pitch detection algorithms analyse segments of about 20 to 50 msec. These segments are referred to as pitch detection segments.

Based on the raw pitch value, a more accurate determination takes place. In step 120, the input signal is divided into a sequence of segments, referred to as the pitch refinement segments. As will be described in more detail below, this is achieved by positioning a chain of time windows with respect to the signal and weighting the signal with the window function of the respective time windows.

In step 130, each pitch refinement segment is filtered to extract the fundamental frequency component (also referred to as the first harmonic) of that segment. The filtering may, for instance, be performed by using a band-pass filter around the first harmonic. It will be appreciated that if the first harmonic is not present in the signal (e.g. the signal is supplied via a telephone line and the lowest frequencies have been lost) a first higher harmonic which is present may be extracted and used to accurately detect this representation of the pitch. For many applications it is sufficient if one of the harmonics, preferably one of the lower harmonics, is accurately detected. It is not always required that the actually lowest harmonic is detected. Preferably, the filtering is performed by convolution of the input signal with a sine/cosine pair as will be described in more detail below.

In step 140, a concatenation occurs of the filtered pitch refinement segments. The filtered pitch detection segments are concatenated by locating each segment at the original time instant and adding the segments together (the segments may overlap). The concatenation results in obtained a filtered signal. In step 150, an accurate value for the pitch period/frequency is determined from the filtered signal. In principle, the pitch period can be determined as the time interval between maximum and/or minimum amplitudes of the filtered signal. Advantageously, the pitch period is determined based on successive zero crossings of the filtered signal, since it is easier to determine the zero crossings. Normally, the filtered signal is formed by digital samples, sampled at, for instance, 8 or 16 Khz. Preferably, the accuracy of determining the moments at which a desired amplitude (e.g. the maximum amplitude or the zero-crossing) occurs in the signal is increased by interpolation. Any con ventional interpolation technique may be used (such as a parabolic interpolation for determining the moment of maximum amplitude or a linear interpolation for determining the moment of zero crossing). In this way accuracy well above the sampling rate can be achieved.

It will be appreciated that the accurate way of determining the pitch as described above can also be used for coding an audio equivalent signal or other ways of manipulating such a signal. For instance, the pitch detection may be used in speech recognition systems, specifically for eastern languages, or in speech synthesis systems for allowing a pitch synchronous manipulation (e.g. pitch adjustment or lengthening).

Segmenting

The sequence of pitch refinement segments is formed by positioning a chain of mutually overlapping or adjacent time windows with respect to the signal. Each time window is associated with a respective window function. The signal is weighted according to the associated window function of a respective window of the chain of windows. In this way each window results in the creation of a corresponding segment. In principle, the window function may be a block form. This results in effectively cutting the input signal into non-overlapping neighbouring segments. For this, the window function used to form the segment may be a straightforward block wave:

$$W(t)=1, \text{ for } 0 \leqq t < L$$

$$W(t)=0, \text{ otherwise.}$$

Figure 2:
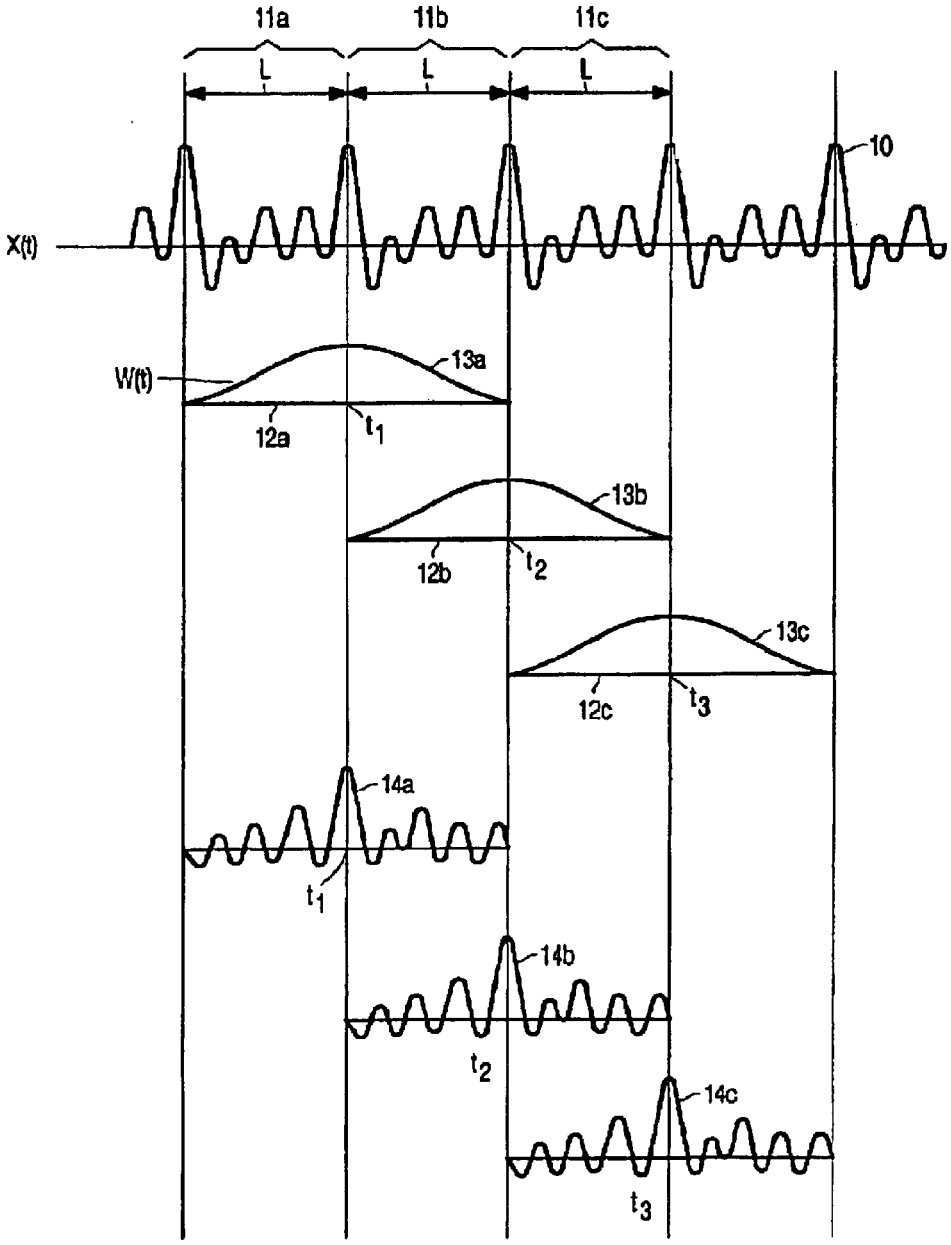
FIG. 2 shows segmenting a signal.
Figure 3A:
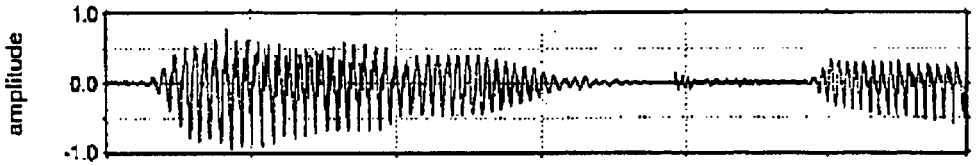
FIG. 3 shows the results of the first harmonic filtering.
Figure 3B:
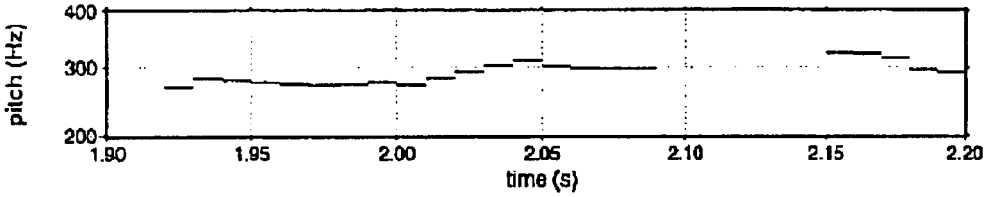
Figure 3C:
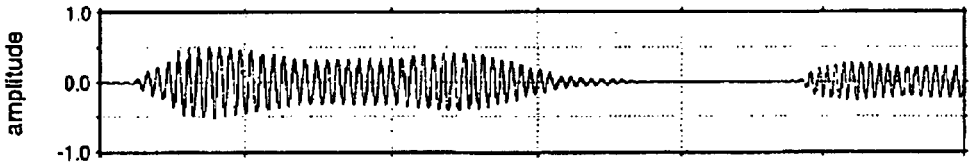
Figure 3D:
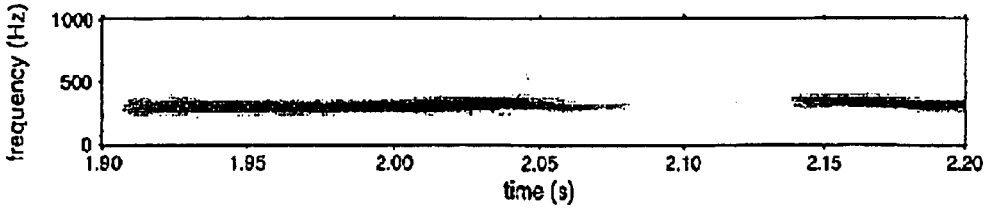

It is preferred to use windows which are wider than the displacement of the windows (i.e. the windows overlap). Preferably each window extends to the centre of the next window. In this way each point in time of the speech signal is covered by (typically) two windows. The window function varies as a function of the position in the window, where the function approaches zero near the edge of the window. Preferably, the window function is "self-complementary" in the sense that the sum of the two window functions covering the same time point in the signal is independent of the time point. An example of such windows is shown in FIG. 2. A self-complementary function can be described as:

$$W(t)+W(t-L)=\text{constant, for } 0 \leqq t < L.$$

This condition is, for instance, met when $$W(t)=\tfrac{1}{2}-A(t)\cos[2\pi/L+\phi(t)]$$

where A(t) and $\phi(t)$ are periodic functions of t, with a period of L. A typical window function is obtained when A(t)=½ and $\phi(t)=0$. Well-known examples of such self-complementary window functions are the Hamming or Hanning window. Using windows, which are wider than the displacement, results in obtaining overlapping segments.

In FIG. 2, the segmenting technique is illustrated for a periodic section of the audio equivalent signal 10. In this section, the signal repeats itself after successive periods 11*a*, 11*b*, 11*c* of duration L (the pitch period). For a speech signal, such a duration is on average approximately 5 msec. for a female voice and 10 msec. for a male voice. A chain of time windows 12*a*, 12*b*, 12*c* is positioned with respect to the signal 10. In FIG. 2 overlapping time windows are used, centred at time points "ti" (i=1,2,3 . . . ). The shown windows each extend over two periods "L", starting at the centre of the preceding window and ending at the centre of the succeeding window. As a consequence, each point in time is covered by two windows. Each time window 12*a*, 12*b*, 12*c* is associated with a respective window function W(t) 13*a*, 13*b*, 13*c*. A first chain of signal segments 14*a*, 14*b*, 14*c* is formed by weighting the signal 10 according to the window functions of the respective windows 12*a*, 12*b*, 12*c*. The weighting implies multiplying the audio equivalent signal 100 inside each of the windows by the window function of the window. The segment signal Si(t) is obtained as $$Si(t)=W(t)\,X(t-ti)$$

FIG. 2 shows windows 12 that are positioned centred at points in time where the vocal cords are excited. Around such points, particularly at the sharply defined point of closure, there tends to be a larger signal amplitude (especially at higher frequencies). As will be described in more detail below, the pitch refinement segments may also be used for pitch and/or duration manipulation. Using such manipulation techniques, for signals with their intensity concentrated in a short interval of the period, centring the windows around such intervals will lead to most faithful reproduction of the signal. It is known from EP-A 0527527 and EP-A 0527529 that, in most cases, for good perceived quality in speech reproduction it is not necessary to centre the windows around points corresponding to moments of excitation of the vocal cords or for that matter at any detectable event in the speech signal. Rather, good results can be achieved by using a proper window length and regular spacing. Even if the window is arbitrarily positioned with respect to the moment of vocal cord excitation, and even if positions of successive windows are slowly varied good quality audible signals are achieved. For such a technique it is sufficient if the windows are placed incrementally, at local period lengths apart, without an absolute phase reference.

In a simple system, the time windows may be displaced using a fixed time offset. Such an offset is preferably chosen sufficiently short to avoid smearing of a pitch change. For most voices a fixed displacement of substantially 10 msec. allows for an accurate filtering of the segment without too much smearing. For high-pitched voices an even shorter displacement may be used. Advantageously, the outcome of the raw pitch detection is used to determine a fixed displacement for the pitch refinement segments. Preferably, the displacement substantially corresponds to the lowest detected pitch period. So, for a male voice with a lowest detected pitch of 100 Hz, corresponding to a pitch period of 10 msec., a fixed displacement of 10 msec. is used. For a female voice with a lowest pitch of 180 Hz, the displacement is approximately 5.6 msec. In this way each pitch refinement segment is kept to a minimum fixed size, which is sufficient to cover two pitch periods for overlapping segment, while at the same time avoiding that the segment unnecessarily covers more than two pitch periods.

Preferably, the windows are displaced substantially over a local pitch period. In this way 'narrow' pitch refinement segments are obtained (for a block-shape window, the width of the segment corresponds substantially to the local pitch period; for overlapping segments this may be twice the local pitch period). As such the duration of the pitch refinement segments is pitch synchronous: the segment duration follows the pitch period. Since, the pitch and other aspects of the signal, such as the ratio between a periodic and aperiodic part of the signal, can change quickly, using narrow pitch refinement segments allows for an accurate pitch detection.

Using the described type of overlapping time windows, a fixed displacement of, for instance, 10 msec. results in the segments extending twice as long (e.g. over 20 msec. of the signal).

Particularly if the pitch refinement segments are also used for other operations, such as duration or pitch manipulation, as described in more detail below, it is desired to preserve the self-complementarity of the window functions. If the displacement of the pitch refinement segment follows the raw pitch period, this can be achieved by using a window function with separately stretched left and right parts (for t<0 and t>0 respectively)

$$Si(t)=W(t/Li)\ X(t+ti)\ (-Li<t<0)$$

$$Si(t)=W(t/Li+1)X(t+ti)\ (0<t<Li+1)$$

each part being stretched with its own factor (Li and Li+1 respectively). Both parts are stretched to obtain the duration of a pitch period of the corresponding part of the signal. Particularly if the pitch detection segments are longer than the pitch refinement segments, the separate stretching occurs when a pitch refinement segment overlaps two pitch detection segments. At such moments, separate stretching may be used, to obtain an optimal result. However, in a simpler system the displacement (related stretching of the window) may be chosen to correspond to an average of the involved raw pitch periods. Preferably, in such a situation then a weighted average is used, where the weights of the involved pitch periods correspond to the overlap with the involved pitch detection segments.

Filtering

In a preferred embodiment, the pitch detection segments are filtered using a convolution of the input signal with a sine/cosine pair. The modulation frequency of the sine/cosine pair is set to the raw pitch value of the corresponding part of the signal. The convolution technique is well known in the field of signal processing. In short, a sine and cosine are located with respect to the segment. For each sample in the segment, the value of the sample is multiplied by the value of the sine at the corresponding time. All obtained products (multiplication results) are subtracted from each other, giving the imaginary part of the pitch frequency component in the frequency domain. Similarly, for each sample in the segment, the value of the sample is multiplied by the value of the cosine at the corresponding time. All obtained products (multiplication results) are added together, giving the real part of the pitch frequency component in the frequency domain. The amplitude of the pitch frequency component is then given as the square root of the sum of the squares of the real and imaginary parts. The phase is given as the arctan of the imaginary part divided by the real part (with corrections to bring the phase within the desired range and to deal with a real part equal to zero).

The following "C" code shows the convolution.

```
void CalculateAmplitudeAndPhase( double pitchFreq, double sampleRate,
double samples[ ], long numSamples, double *ampl, double *phase )
{
double a = 2.0 * PI / (sampleRate / pitchFreq);
double real = 0.0; double imag = 0.0;
unsigned i;
for (i=0; i<numSamples; i++) {
        real += samples[i] * cos(i * a);
        imag -= samples[i] * sin(i * a);
}
*ampl = sqrt( real * real + imag * imag );
*phase =
```

-continued

```
real > 0.0 ? atan( imag / real ): real < 0.0 ? atan( imag / real ) + PI :
        imag > = 0.0 ? 0.5 * PI : 1.5 * PI;
}
```

Based on the convolution results, a filtered pitch refinement segment corresponding to the pitch refinement segment is created. This is done by generating a cosine (or sine) with a modulation frequency set to the raw pitch value and the determined phase and amplitude. The cosine is weighted with the respective window to obtain a windowed filtered pitch refinement segment.

The results of the 'first-harmonic filtering' technique according to the invention are shown in FIG. 3. FIG. 3A shows a part of the input signal waveform of the word "(t)went(y)" spoken by a female. FIG. 3B shows the raw pitch value measured using a conventional technique. FIGS. 3C and 3D, respectively, show the waveform and spectogram after performing the first-harmonic filtering of the input signal of FIG. 3A.

Figure 4:
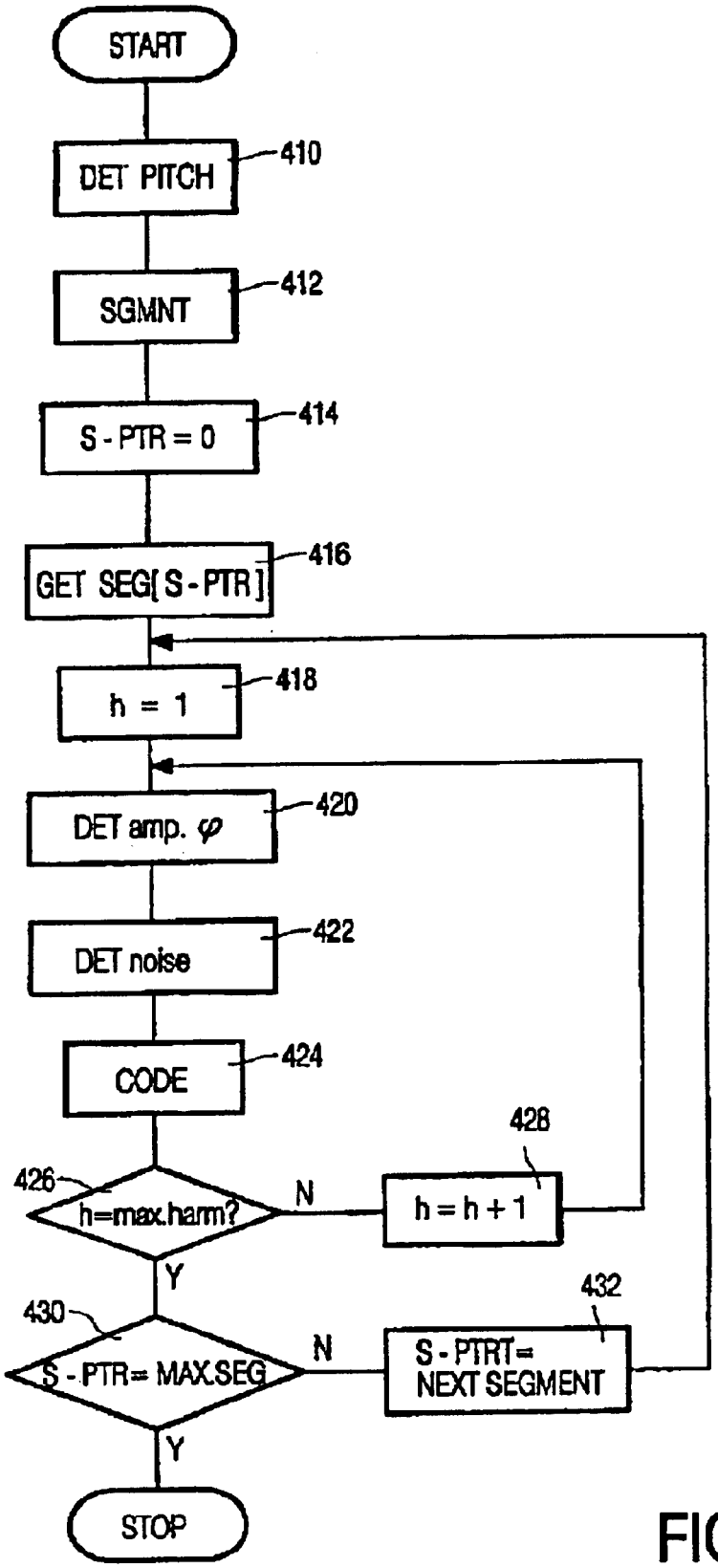
FIG. 4 shows an overall coding method based on accurate pitch detection according to the invention.

The pitch refinement technique of the invention may be used in various applications requiring an accurate measure of the pitch. An example is shown in FIG. 4, where the technique is used for coding an audio equivalent signal. In step 410, the development of the pitch period (or as an equivalent: the pitch frequency) of an audio equivalent input signal is detected. The signal may, for instance represent a speech signal or a speech signal fragment such as used for diphone speech synthesis. Although the technique is targeted towards speech signals, the technique may also be applied to other audio equivalent signals, such as music. For such signals, the pitch frequency may be associated with the dominant periodic frequency component. The description focuses on speech signals.

In step 412, the signal is broken into a sequence of mutually overlapping or adjacent analysis segments. Advantageously, the analysis segments correspond to the pitch refinement segments as described above. For forming the segments, a chain of time windows is positioned with respect to the input signal. Each time window is associated with a window function. By weighting the signal according to the window function of the respective windows, the segments are created.

In the following steps each of the analysis segments is analysed in a pitch synchronous manner to determine the phase values (and preferably at the same time also the amplitude values) of a plurality of harmonic frequencies within the segment. The harmonic frequencies include the pitch frequency, which is referred to as the first harmonic. The pitch frequency relevant for the segment has already been determined in step 410. The phase is determined with respect to a predetermined time instant in the segment (e.g. the start or the centre of the segment). To obtain the highest quality coding, as many as possible harmonics are analysed (within the bandwidth of the signal). However, if for instance a band-filtered signal is required only the harmonics within the desired frequency range need to be considered. Similarly, if a lower quality output signal is acceptable, some of the harmonics may be disregarded. Also for some of the harmonics only the amplitude may be determined where the noise value is determined for a subset of the harmonics. Particularly for the lower harmonics the signal tends to be mainly periodic, making it possible to use an estimated noise value for those harmonics. Moreover, the noise value changes more gradually than the amplitude. This makes it possible to determine the noise value for only a subset of the harmonics (e.g. once for every two successive harmonics). For those harmonics for which no noise value has been determined, the noise value can be estimated (e.g. by interpolation). To obtain a high quality coding, the noise value is calculated for all harmonics within the desired frequency range. If representing all noise values would require too much storage or transmission capacity, the noise values can efficiently be compressed based on the relative slow change of the noise value. Any suitable compression technique may be used.

In step 414 the first segment is selected indicated by a segment pointer (s–ptr=0). The segment is retrieved (e.g. from main memory or a background memory) in step 416. In step 418 the first harmonic to be analysed is selected (h=1). In step 420, the phase (and preferably also the amplitude) of the harmonic is determined. In principle any suitable method for determining the phase may be used. Next in step 422, for the selected harmonic frequency a measure (noise value) is determined which indicates the contribution of a periodic signal component and an aperiodic signal component (noise) to the selected analysis segment at that frequency. The measure may be a ratio between the components or an other suitable measure (e.g. an absolute value of one or both of the components). The measure is determined by, for each of the involved frequencies, comparing the phase of the frequency in a segment with the phase of the same frequency in a following segment (or, alternatively, preceding segment). If the signal is highly dominated by the periodic signal, with a very low contribution of noise, the phase will substantially be the same. On the other hand for a signal dominated by noise, the phase will 'randomly' change. As such the comparison of the phase provides an indication for the contribution of the periodic and aperiodic components to the input signal. It will be appreciated that the measure may also be based on phase information from more than two segments (e.g. the phase information from both neighbouring segments may be compared to the phase of the current segment). Also other information, such as the amplitude of the frequency component may be taken into consideration, as well as information of neighbouring harmonics.

In step 424, coding of the selected analysis segment occurs by, for each of the selected frequency component, storing the amplitude value and the noise value (also referred to as noise factor). It will be appreciated that since the noise value is derived from the phase value as an alternative to storing the noise value also the phase values may be stored.

In step 426 it is checked whether all desired harmonics have been encoded; if not, the next harmonic to be encoded is selected in step 428. Once all harmonics have been encoded, in step 430 it is checked whether all analysis segments have been dealt with. If not, in step 432 the next segment is selected for encoding.

The encoded segments are used at a later stage. For instance, the encoded segments are transferred via a telecommunications network and decoded to reproduce the original input signal. Such a transfer may take place in 'real-time' during the encoding. The coded segments are preferably used in a speech synthesis (text-to-speech conversion) system. For such an application, the encoded segments are stored, for instance, in background storage, such as a harddisk or CD-ROM. For speech synthesis, typically a sentence is converted to a representation which indicates which speech fragments (e.g. diphones) should be concatenated and the sequence of the concatenation. The representation also indicates the desired prosody of the sentence. Compared with information, such as duration and pitch, available for the stored encoded segments, this indicates how the pitch and duration of the involved segments should be manipulated. The involved fragments are retrieved from the storage and decoded (i.e. converted to a speech signal, typically in a digital form). The pitch and/or duration is manipulated using a suitable technique (e.g. the PSOLA/PIOLA manipulation technique).

The coding according to the invention may be used in speech synthesis systems (text-to-speech conversion). In such systems decoding of the encoded fragments may be followed by further manipulation of the output signal fragment using a segmentation technique, such as PSOLA or PIOLA. These techniques use overlapping windows with a duration of substantially twice the local pitch period. If the coding is performed for later use in such applications, preferably already at this stage the same windows are used as are also used to manipulate the prosody of the speech during the speech synthesis. In this way, the signal segments resulting from the decoding can be kept and no additional segmentation need to take place for the prosody manipulation.

Determining the Noise Value for the Harmonics

Once an accurate pitch frequency has been determined, a phase value is deter mined for a plurality of harmonics of the fundamental frequency (pitch frequency) as derived from the accurately determined pitch period. Preferably, a transformation to the frequency domain, such as a Discrete Fourier Transform (DFT), is used to determine the phase of the harmonics, where the accurately determined pitch frequency is used as the fundamental frequency for the transform. This transform also yields amplitude values for the harmonics, which advantageously are used for the synthesis/decoding at a later stage. The phase values are used to estimate a noise value for each harmonic. If the input signal is periodic or almost periodic, each harmonic shows a phase difference between successive periods that is small or zero. If the input signal is aperiodic, the phase difference between successive periods for a given harmonic will be random. As such the phase difference is a measure for the presence of the periodic and aperiodic components in the input signal. It will be appreciated that for a substantially aperiodic part of the signal, due to the random behaviour of the phase difference no absolute measure of the noise component is obtained for individual harmonics. For instance, if at a given harmonic frequency the signal is dominated by the aperiodic component, this may still lead to the phases for two successive periods being almost the same. However, on average, considering several harmonics, a highly period signal will show little phase change, whereas a highly aperiodic signal will show a much higher phase change (on average a phase change of π). Preferably a 'factor of noisiness' in between 1 and 0 is determined for each harmonic by taking the absolute value of the phase differences and dividing them by 2π. In voiced speech (highly period signal) this factor is small or 0, while for a less period signal, such as voiced fricatives, the factor of noisiness is significantly higher than 0. Preferably, the factor of noisiness is determined in dependence on a derivative, such as the first or second derivative, of the phase differences as a function of frequency. In this way more robust results are obtained. By taking the derivative components of the phase spectrum, which are not affected by the noise, are removed. The factor of noisiness may be scaled to improve the discrimination.

Figure 5A:
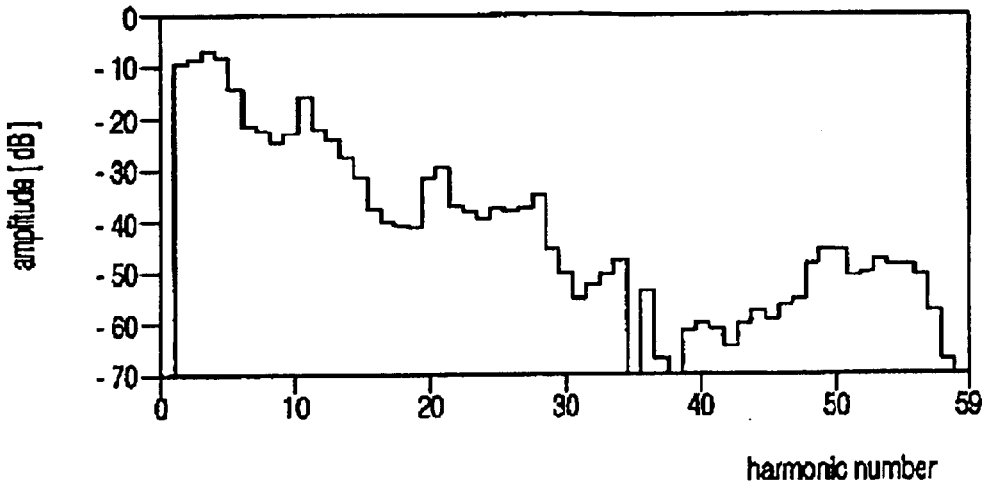
FIG. 5 shows the noise value using the analysis based on the accurate pitch detection according to the invention.
Figure 5B:
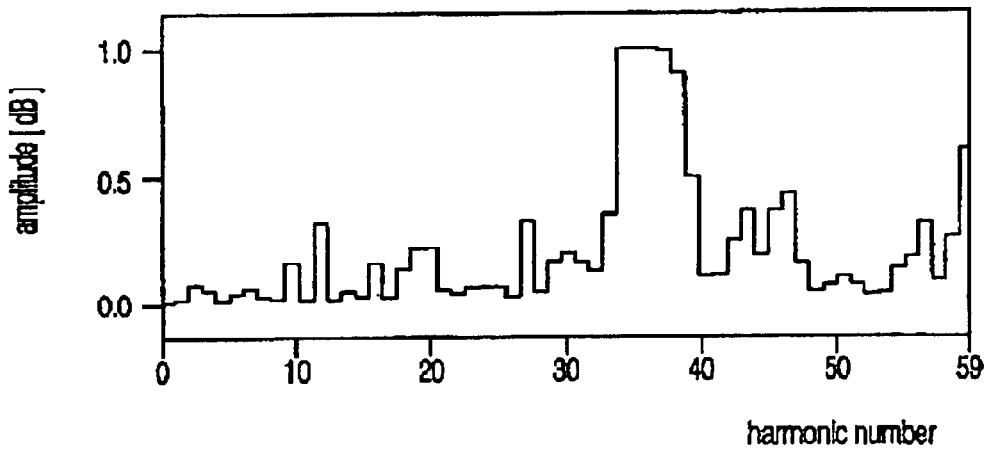

FIG. 5 shows an example of the 'factor of noisiness' (based on a second derivative) for all harmonics in a voiced frame. The voiced frame is a recording of the word "(kn)o (w)", spoken by a male, sampled at 16 Khz. FIG. 5A shows the spectrum representing the amplitude of the individual harmonics, determined via a DFT with a fundamental frequency of 135.41 Hz, determined by the accurate pitch frequency determination method according to the invention. A sampling rate of 16 Khz was used, resulting in 59 harmonics. It can be observed that some amplitude values are very low from the 35th to 38the harmonic. FIG. 5B shows the 'factor of noisiness' as found for each harmonic using the method according to the invention. It can now very clearly be observed that a relatively high 'noisiness' occurs in the region between the 32nd and 39th harmonic. As such the method according to the invention clearly distinguishes between noisy and less noisy components of the input signal. It is also clear, that the factor of noisiness can significantly vary in dependence on the frequency. If desired, the discrimination may be increased even further by also considering the amplitude of the harmonic, where comparatively low amplitude of a harmonic indicates a high level of noisiness. For instance, if for a given harmonic the phase difference between two successive periods is low due to random behaviour of noise which is highly present at that frequency, the factor of noisiness is preferably corrected from being close to 0 to being, for instance, 0.5 (or even higher) if the amplitude is low, since the low amplitude indicates that at that frequency the contribution of the aperiodic component is comparable to or even higher than the contribution of the periodic component.

The analysis described above is preferably only performed for voiced parts of the signal (i.e. those parts with an identifiable periodic component). For unvoiced parts, the 'factor of noisiness' is set to 1 for all frequency components, being the value indicating maximum noise contribution. Depending on the type of synthesis used to synthesise an output signal, it may be required to obtain also information for the unvoiced parts of the input signal. Preferably, this is done using the same analysis method as described above for the voiced parts, where using an analysis window of, for instance, a fixed length of 5 msec., the signal is analysed using a DFT. For the synthesis of the unvoiced parts only the amplitude needs to be calculated; the phase information is not required since the noise value is fixed.

Synthesis

Preferably, a signal segment is created from the amplitude information obtained during the analysis for each harmonic. This can be done by using suitable transformation from the frequency domain to the time domain, such as an inverse DFT transform. Preferably, the so-called sinusoidal synthesis is used. According to this technique, a sine with the given amplitude is generated for each harmonic and all sines are added together. It should be noted that this normally is performed digitally by adding for each harmonic one sine with the frequency of the harmonics and the amplitude as determined for the harmonic. It is not required to generate parallel analogue signals and add those signals. The amplitude for each harmonic as obtained from the analysis represents the combined strength of the period component and the aperiodic component at that frequency. As such the re-synthesised signal also represents the strength of both components.

For the periodic component, in principle the phase can be freely chosen for each harmonic. According to the invention, for a given harmonic the initial phase for successive signal segments is chosen such that if the segments are concatenated (if required in an overlapping manner, as described in more detail below), no uncontrolled phase-jumps occur in the output signal. For instance, a segment has a duration corresponding to a multiple (e.g. twice) of the pitch period and the phase of a given harmonic at the start of the segments (and, since the segments last an integer multiple of the harmonic period, also at the end of the segments) are chosen to be the same. By avoiding a phase jump in concatenation of successive segments the naturalness of the output signal is increased, compared to the conventional diphone speech synthesis based on the PIOLA/PSOLA technique. Using these techniques a reasonable quality synthesis speech has been achieved by concatenating recorded actual speech fragments, such as diphones. With these techniques a high level of naturalness of the output can be achieved within a fragment. The speech fragments are selected and concatenated in a sequential order to produce the desired output. For instance, text input (sentence) is transcribed to a sequence of diphones, followed by obtaining the speech fragments (diphones) corresponding to the transcription. Normally, the recorded speech fragments do not have the pitch frequency and/or duration corresponding to the desired prosody of the sentence to be spoken. The pitch and/or duration is manipulated by breaking the basic speech signal into segments. The segments are formed by positioning a chain of windows along the signal. Successive windows are usually displaced over a duration similar to the local pitch period. In the system of EP-A 0527527 and EP-A 0527529, referred to as the PIOLA system, the local pitch period is automatically detected and the windows are displaced according to the detected pitch duration. In the so-called PSOLA system of EP-A 0363233 the windows are centred around manually determined locations, so-called voice marks. The voice marks correspond to periodic moments of strongest excitation of the vocal cords. An output signal is produced by concatenating the signal segments. A lengthened or shortened output signal is obtained by repeating or suppressing segments. The pitch of the output signal is raised, respectively, lowered by increasing or, respectively, lowering the overlap between the segments. Applied on running speech the quality of speech manipulated in this way can be very high, provided the range of the pitch changes is not too large. Complications arise, however, if the speech is built from relatively short speech fragments, such as diphones. The harmonic phase courses of the voiced speech parts may be quite different and it is difficult to generate smooth transitions at the borders between successive fragments, reducing the naturalness of the synthesised speech. In such systems the coding technique according to the invention can advantageously be applied. By not operating on the actual audio equivalent fragments with uncontrollable phase, instead fragments are created from the encoded fragments according to the invention. Using a suitable decoding technique, like the described sinusoidal synthesis, the phase of the relevant frequency components can be fully controlled, so that uncontrolled phase transitions at fragment boundaries can be avoided.

It is not required that within one segment all harmonics start with the same phase. In fact, it is preferred that the initial phases of the various harmonics are reasonably distributed between 0 and $2\pi$. For instance, the initial value may be set at (a fairly arbitrary) value of:

$$2\pi(k-0.5)/k,$$

where k is the harmonic number and time zero is taken at the middle of the window. This distribution of non-zero values over the spectrum spreads the energy of the synthesised signal in time and prevents high peaks in the synthesised waveform.

The aperiodic component is represented by using a random part in the initial phase of the harmonics which is added to the described initial value. For each of the harmonics, the amount of randomness is determined by the 'factor of noisiness' for the harmonic as determined in the analysis. If no noticeable aperiodic component is observed, no noise is added (i.e. no random part is used), whereas if the aperiodic component is dominant the initial phase of the harmonic is significantly subjected to a random change (for a fully aperiodic signal up to the maximum phase variation between $-\pi$ and $\pi$). If the random noise factor is defined as given above where 0 indicates no noise and 1 indicates a 'fully aperiodic' input signal, the random part can be obtained by multiplying the random noise factor by a random number between $-\pi$ and $+\pi$. Generation of non-repetitive noise signals yields a significant improvement of the perceived naturalness of the generated speech. Tests, wherein a running speech input signal is analysed and re-synthesised according to the invention, show that hardly any difference can be heard between the original input signal and the output signal. In these tests no pitch or duration manipulation of the signal took place.

Manipulation of Duration or Pitch

In FIG. 2, segments $S_i(t)$ were obtained by weighting the signal 10 with the respective window function W(t). The segments were stored in a coded form and recreated. By straightforward superposing the decoded segments a signal is recreated which is similar to the original input signal but with a controlled phase behaviour. Preferably, the recreated segments are kept allowing for manipulation of the duration or pitch of a sequence of decoded speech fragments via the following overlap and add technique.

Figure 6A:
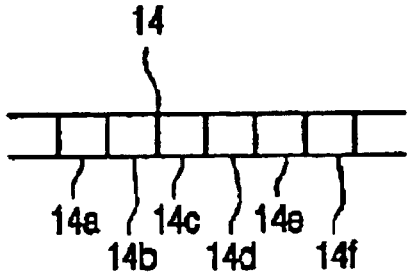
FIG. 6 illustrates lengthening a synthesised signal.
Figure 6B:
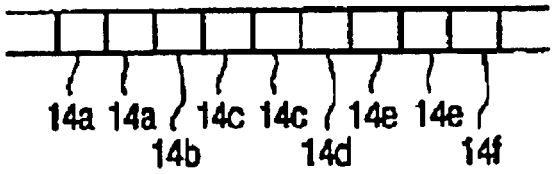
Figure 6C:
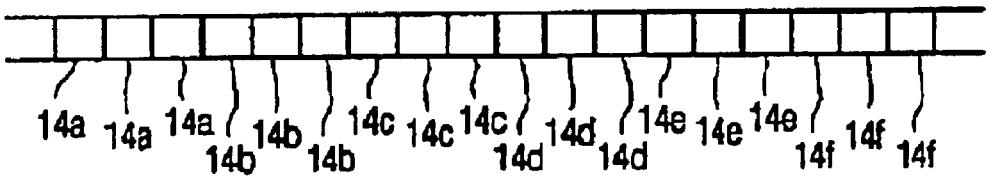

FIG. 6 illustrates forming a lengthened audio signal by systematically maintain ing or repeating respective signal segments. The signal segments are preferably the same segments as obtained in step 412 of FIG. 4 (after encoding and decoding). In FIG. 6A a first sequence 14 of signal segments 14*a* to 14*f* is shown. FIG. 6B shows a signal which is 1.5 times as long in duration. This is achieved by maintaining all segments of the first sequence 14 and systematically repeating each second segment of the chain (e.g. repeating every "odd" or every "even" segment). The signal of FIG. 6C is lengthened by a factor of 3 by repeating each segment of the sequence 14 three times. It will be appreciated that the signal may be shortened by using the reverse technique (i.e. systematically suppressing/skipping segments).

The lengthening technique can also be used for lengthening parts of the audio equivalent input signal with no identifiable periodic component. For a speech signal, an example of such a part is an unvoiced stretch, that is a stretch containing fricatives like the sound "ssss", in which the vocal cords are not excited. For music, an example of a non-periodic part is a "noise" part. To lengthen the duration of substantially non-periodic parts, in a way similar as for the periodic parts, windows are placed incrementally with respect to the signal. The windows may still be placed at manually determined positions. Alternatively successive windows are displaced over a time distance which is derived from the pitch period of periodic parts, surrounding the non-period part. For instance, the displacement may be chosen to be the same as used for the last periodic segment (i.e. the displacement corresponds to the period of the last segment). The displacement may also be determined by interpolating the displacements of the last preceding periodic segment and the first following periodic segment. Also a fixed displacement may be chosen, which for speech preferably is sex-specific, e.g. using a 10 msec. displacement for a male voice and a 5 msec. displacement for a female voice.

For lengthening the signal, in principle non-overlapping segments can be used, created by positioning the windows in a non-overlapping manner, simply adjacent to each other. If the same technique is also used for changing the pitch of the signal it is preferred to use overlapping windows, for instance like the ones shown in FIG. 2. Advantageously, the window function is self-complementary. The self-complementary property of the window function ensures that by superposing the segments in the same time relation as they are derived, the original signal is retrieved. The decoded segments Si(t) are superposed to obtain an output signal Y(t). A pitch change of locally periodic signals (like for example voiced speech or music) can be obtained by placing the segments at new positions Ti, differing from the original positions ti (i=1,2,3 . . . ) before superpositioning the segments. To form, for example, an output signal with increased pitch, the segments are superposed with a corn pressed mutual centre to centre distance as compared to the distance of the segments as derived from the original signal. The lengths of the segments are kept the same. Finally, the segment signals are summed to obtain the superposed output signal Y:

$$Y(t)=\Sigma i\ Si(t-Ti)$$

(In the example of FIG. 2 with the windows being two periods wide, the sum is limited to indices i for which $-L<t-Ti<L$). By nature of its construction this output signal Y(t) will be periodic if the input signal 10 is periodic, but the period of the output differs from the input period by a factor $$(ti-ti-1)/(Ti-Ti-1)$$

that is, as much as the mutual compression/expansion of distances between the segments as they are placed for the superpositioning. If the segment distance is not changed, the output signal Y(t) reproduces the input audio equivalent signal X(t). Changing the time positions of the segments results in an output signal which differs from the input signal in that it has a different local period, but the envelope of its spectrum remains approximately the same. Perception experiments have shown that this yields a very good perceived speech quality even if the pitch is changed by more than an octave.

It will be appreciated that a side effect of raising the pitch is that the signal gets shorter. This may be compensated by lengthening the signal as described above.

The duration/pitch manipulation method transforms periodic signals into new periodic signals with a different period but approximately the same spectral envelope. The method may be applied equally well to signals which have a locally determined period, like for example voiced speech signals or musical signals. For these signals, the period length L varies in time, i.e. the i-th period has a period-specific length Li. In this case, the length of the windows must be varied in time as the period length varies, and the window functions W(t) must be stretched in time by a factor Li, corresponding to the local period, to cover such windows:

$$Si(t)=W(t/Li)\ X(t-ti)$$

For self-complementary, overlapping windows, it is desired to preserve the self-complementarity of the window functions. This can be achieved by using a window function with separately stretched left and right parts (for $t<0$ and $t>0$ respectively)

$$Si(t)=W(t/Li)\ X(t+ti)\ (-Li<t<0)$$

$$Si(t)=W(t/Li+1)X(t+ti)\ (0<t<Li+1)$$

each part being stretched with its own factor (Li and Li+1 respectively). These factors are identical to the corresponding factors of the respective left and right overlapping windows.

Experiments have shown that locally periodic input audio equivalent signal fragments manipulated in the way described above lead to output signals which to the human ear have the same quality as the input audio equivalent signal, but with a different pitch and/or duration. By now applying the coding method of the invention, it can be ensured that no phase jumps occur for the harmonic frequencies at the places where a transition occurs between speech fragment. In this way, particularly for speech synthesis based on concatenation of relatively short speech fragments, the quality is improved. Tests have shown that the improvement in speech-synthesis due to using segments with a controlled phase for the harmonics are even more noticeable when segments are repeated in order to lengthen the signal. Repetition of segments, even if the segments in itself are highly aperiodic, results in a signal which is observed as containing a periodic elements. By for the aperiodic segments ensuring that the phase of successive segments changes substantially randomly, repetition is avoided.

A full implementation of the coding and synthesis method has been realised and compared with several other vocoder implementations, among which the classical LPC vocoder. For manipulation of pitch and duration the synthesis based on the pitch refinement technique of the invention has shown to be superior. The test system allowed manipulation of the original pitch and duration contours. Speech synthesised with these new pitch courses according to the new method sounds much better than after the conventional PSOLA manipulation acting directly on originally recorded speech fragments. Also a substantial lengthening of unvoiced speech parts yields much better results when applying the new method. During these tests, each repeated segment is synthesised with noise from new random numbers, avoiding the artefact of introducing periodicity in noise signals.

The described methods for pitch refinement, as for instance used for coding and synthesis, can be implemented in suitable apparatuses and systems. Such apparatuses may be build using conventional computer technology and programmed to perform the steps according to the invention. Typically, an encoder according to the invention comprises an A/D converter for converting an analogue audio input signal to a digital signal. The digital signal may be stored in main memory or in a background memory. A processor, such as a DSP, can be programmed to perform the encoding. As such the programmed processor performs the task of determining successive pitch periods/frequencies in the signal. The processor also forms a sequence of mutually overlapping or adjacent pitch refinement/analysis segments by positioning a chain of time windows with respect to the signal and weighting the signal according to an associated window function of the respective time window. The processor can filter each of the refinement segments to extract the frequency component which corresponds to the pitch period detected for the part of the signal corresponding to the segment. Preferably, the processor is programmed to perform this filtering by means of a convolution with a sine/cosine pair and recreating a corresponding windowed sine or cosine. If desired also a separate digital or analogue bandpass filter may be used. For coding, the processor is preferably also programmed to determine an amplitude value and a phase value for a plurality of frequency components of each of the analysis segments, the frequency components including a plurality of harmonic frequencies of the pitch frequency corresponding to the analysis segment. The processor of the encoder also determines a noise value for each of the frequency components by comparing the phase value for the frequency component of an analysis segment to a corresponding phase value for at least one preceding or following analysis segment; the noise value for a frequency component representing a contribution of a periodic component and an aperiodic component to the analysis segment at the frequency. Finally, the processor represents the audio equivalent signal by the amplitude value and the noise value for each of the frequency components for each of the analysis segments. The processor may store the encoded signal in a storage medium of the encoder (e.g. harddisk, CD-ROM, or floppy disk), or transfer the encoded signal to another apparatus using communication means, such as a modem, of the encoder. The encoded signal may be retrieved or received by a decoder, which (typically under control of a processor) decodes the signal. The decoder creates for each of the selected coded signal fragments a corresponding signal fragment by transforming the coded signal fragment to a time domain, where for each of the coded frequency components an aperiodic signal component is added in accordance with the respective noise value for the frequency component. For reproducing the signal the decoder may also comprise a D/A converter and an amplifier. The decoder may be part of a synthesiser, such as a speech synthesiser. The synthesiser selects encoded speech fragments, e.g. as required for the reproduction of a textually represented sentence, decodes the fragments and concatenates the fragments. Also the duration and prosody of the signal may be manipulated.

What is claimed is:

1. A method of determining successive pitch periods/frequencies in an audio equivalent signal; the method comprising:

dividing the audio equivalent signal into a sequence of mutually overlapping or adjacent pitch detection segments;

determining an initial value of the pitch frequency/period for each of the pitch detection segments; and based on the determined initial value, determining a refined value of the pitch frequency/period;

characterised in that the step of determining a refined value of the pitch frequency/period comprises:

forming a sequence of pitch refinement segments by:

positioning a chain of time windows with respect to the audio equivalent signal; and weighting the signal according to an associated window function of the respective time window;

each pitch refinement segment being associated with at least one of the pitch detection segments forming a filtered signal by filtering each pitch refinement segment to extract a frequency component with a frequency substantially corresponding to an initially determined pitch frequency of an associated pitch detection segment; and determining the successive pitch periods/frequencies from the filtered signal.

2. A method of determining successive pitch periods/frequencies as claimed in claim 1, characterised:

in that the step of filtering the pitch segment comprises:

convoluting the pitch detection segment with a sine/cosine pair with a modulation frequency substantially corresponding to the initially estimated pitch frequency, giving an amplitude and phase value for a sine or cosine with the same modulation frequency; and forming a filtered pitch detection segment by generating a windowed sine or cosine with the determined amplitude and phase; and in that the step of forming the filtered signal comprises concatenating the sequence of filtered pitch detection segments.

3. A method of determining successive pitch periods/frequencies as claimed in claim 1, characterised in that the filtered signal is represented as a time sequence of digital samples and that the step of determining the successive pitch periods/frequencies of the filtered signal comprises:

estimating successive instants in which the sequence of samples meets a predetermined condition, such as the sample value being a local maximum/minimum or crossing a zero value, and determining each of the instants more accurately by interpolating a plurality of samples around the estimated instant.

4. A method of determining successive pitch periods/frequencies as claimed in claim 1, characterised in that the step of positioning a chain of time windows with respect to the audio equivalent signal comprises displacing a successive time window with respect to an immediately preceding time window over a time interval which depends on an initially determined pitch frequency of an associated pitch detection segment.

5. A method of determining successive pitch periods/frequencies as claimed in claim 4, characterised in that the displacing comprises displacing the time window over substantially an initially determined pitch period of the associated pitch detection segment.

6. An apparatus for determining successive pitch periods/frequencies in an audio equivalent signal, the apparatus comprising:

segmenting means for forming a sequence of mutually overlapping or adjacent pitch detection segments;

pitch detection means for determining an initial value of the pitch frequency/period for each of the pitch detection segments; and pitch refinement means for, based on the determined initial value, determining a refined value of the pitch frequency/period;

characterised in that the pitch refinement means comprises:

segmenting means for forming a sequence of pitch refinement segments by:

positioning a chain of time windows with respect to the audio equivalent signal; and weighting the signal according to an associated window function of the respective time window;

each pitch refinement segment being associated with at least one of the pitch detection segments;

filtering means for forming a filtered signal by filtering each pitch refinement segment to extract a frequency component with a frequency substantially corresponding to an initially determined pitch frequency of an associated pitch detection segment; and means for determining the successive pitch periods/frequencies from the filtered signal.

* * * * *